United States Patent [19]

Willoby

[11] 4,003,372

[45] Jan. 18, 1977

[54] FOOT WASHING AND MASSAGING DEVICE

[75] Inventor: Carl J. Willoby, Lompoc, Calif.

[73] Assignee: The Raymond Lee Organization, Inc., New York, N.Y. ; a part interest

[22] Filed: Oct. 6, 1975

[21] Appl. No.: 619,639

[52] U.S. Cl. ..... 128/25 B; 4/158; 15/110; 128/65

[51] Int. Cl.[2] ..... A61H 1/02

[58] Field of Search ..... 128/25 B, 67, 65, 62; 4/185 F, 158; 15/110, 215, 216, 223; 272/57 D

[56] References Cited

UNITED STATES PATENTS

| | | | |
|---|---|---|---|
| 1,267,039 | 5/1918 | Akin | 15/110 |
| 1,954,940 | 4/1934 | Mikel | 4/185 F |
| 3,478,369 | 11/1969 | Ensley | 128/65 X |

*Primary Examiner*—Lawrence W. Trapp
*Attorney, Agent, or Firm*—Daniel Jay Tick

[57] ABSTRACT

A plate-like base member of water-impervious material has spaced opposite parallel planar surfaces. A plurality of suction cups are affixed to one of the surfaces of the base member for releasably securing the base member in position on a supporting surface. A sheet of pliable, resilient water-impervious material is affixed to the other of the surfaces of the base member in undulating configuration in a manner whereby when the device is positioned in a shower or tub and the feet of a user are rubbed on the sheet of resilient material, such feet are washed and massaged simultaneously.

5 Claims, 3 Drawing Figures

FOOT WASHING AND MASSAGING DEVICE

DESCRIPTION OF THE INVENTION

The present invention relates to a foot washing and massaging device.

Objects of the invention are to provide a foot washing and massaging device of simple structure, which is inexpensive in manufacture, used with facility, convenience and comfort, and functions efficiently, effectively and reliably to simultaneously wash and massage the feet of a user.

In order that the invention may be readily carried into effect, it will now be described with reference to the accompanying drawing, wherein.

Figure 2:
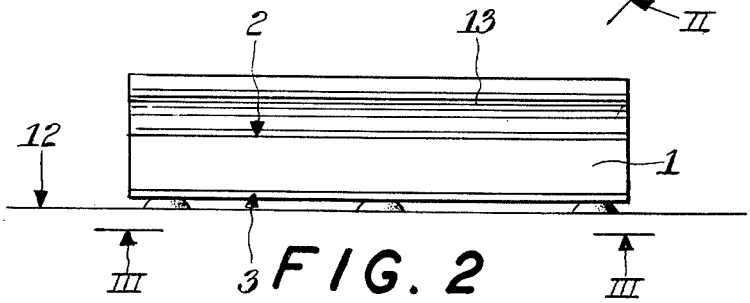
FIG. 2 is a view, taken along the lines II—II, of FIG. 1.

The foot washing and massaging device of the invention comprises a substantially plate-like base member 1 of water-impervious material of any suitable type such as, for example, plastic, having spaced opposite parallel substantially planar surfaces 2 and 3 (FIG. 2).

Figure 3:
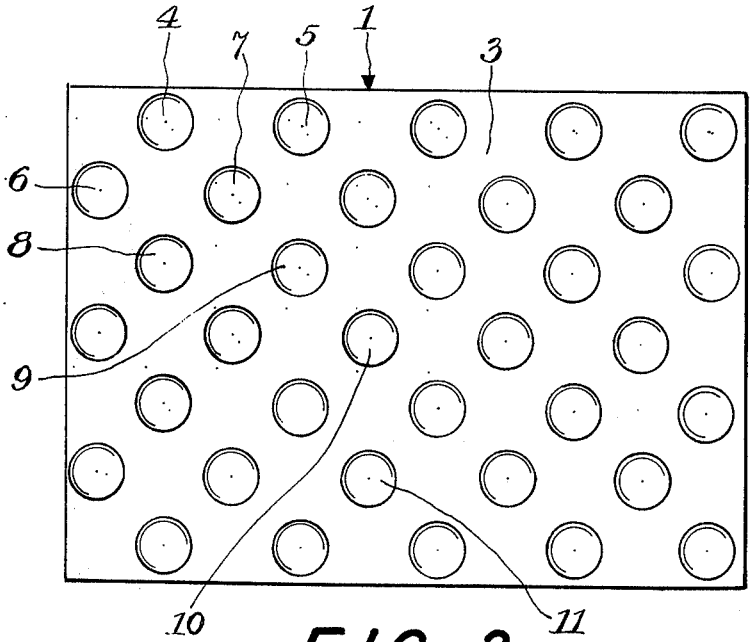
FIG. 3 is a view, taken along the lines III—III, of FIG. 2.

A plurality of suction cups 4, 5, 6, 7, 8, 9, 10, 11, and so on, (FIG. 3) are affixed to the surface 3 of the base member and function to releasably secure the base member in position on a supporting surface 12 (FIG. 2), which is preferably the surface of a shower or bathtub.

Figure 1:
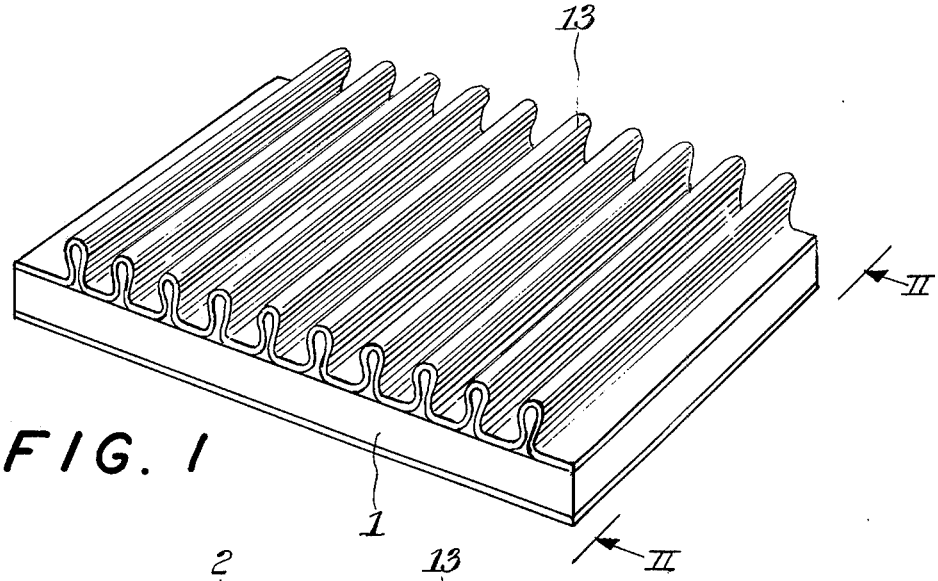
FIG. 1 is a perspective view of an embodiment of the foot washing and massaging device of the invention.

A sheet of pliable, resilient, water-impervious material 13 (FIGS. 1 and 2) of any suitable type such as, for example, vinyl, plastic or rubber, is affixed to the surface 2 of the base member 1 in substantially undulating configuration, as shown in FIG. 1. Thus, when the device of the invention is positioned in a shower or tub and the feet of a user are rubbed on the sheet of resilient material 13, said feet are simultaneously washed and massaged.

While the invention has been described by means of a specific example and in a specific embodiment, I do not wish to be limited thereto, for obvious modifications will occur to those skilled in the art without departing from the spirit and scope of the invention.

I claim:

1. A foot washing and massaging device, comprising a substantially plate-like base member of water-impervious material having spaced opposite parallel substantially planar surfaces;

a plurality of suction cups affixed to one of the surfaces of the base member for releasably securing the base member in position on a supporting surface; and a sheet of pliable, resilient water-impervious material affixed to the other of the surfaces of the base member in substantially undulating configuration in a manner whereby when the device is positioned in a shower or tub and the feet of a user are rubbed on the sheet of resilient material said feet are washed and massaged simultaneously.

2. A foot washing and massaging device as claimed in claim 1, wherein the sheet of resilient material comprises plastic.

3. A foot washing and massaging device as claimed in claim 1, wherein the sheet of resilient material comprises rubber.

4. A foot washing and massaging device as claimed in claim 1, wherein the sheet of resilient material comprises stretch vinyl.

5. A foot washing and massaging device as claimed in claim 1, wherein the sheet of resilient material comprises vinyl.

* * * * *